US005762189A

United States Patent [19]

Reimers

[11] Patent Number: 5,762,189

[45] Date of Patent: Jun. 9, 1998

[54] GOLF BAG STAND SYSTEM

[76] Inventor: Eric W. Reimers, 1235 Starwood, Missoula, Mont. 59802

[21] Appl. No.: 794,196

[22] Filed: Jan. 24, 1997

[51] Int. Cl.[6] ..... A63B 55/00

[52] U.S. Cl. ..... 206/315.7; 248/96

[58] Field of Search ..... 206/315.6, 315.8, 206/315.7; 248/96

[56] References Cited

U.S. PATENT DOCUMENTS

| | | | |
|---|---|---|---|
| 1,924,182 | 8/1933 | Fritz | 248/96 |
| 4,522,299 | 6/1985 | Clark et al. | 206/315.3 |
| 5,147,089 | 9/1992 | Anderson | 206/315.7 |
| 5,152,483 | 10/1992 | Maeng | 248/96 |
| 5,209,350 | 5/1993 | Maeng | 248/96 |
| 5,340,063 | 8/1994 | Hsieh | 206/315.7 X |
| 5,390,788 | 2/1995 | Schenkkan | 206/315 |
| 5,415,285 | 5/1995 | Reimers | 206/315.7 |
| 5,464,180 | 11/1995 | Cheng | 206/315.7 |

*Primary Examiner*—Allan N. Shoap
*Assistant Examiner*—Tri M. Mai
*Attorney, Agent, or Firm*—Michael J. Hughes; Mark E. Baze

[57] ABSTRACT

A stand system (10) for golf bags provides an automatic leg deployment and retraction capability and offers an exceedingly smooth and efficient operation and design. The stand system (10) includes a golf bag (12) having a base member (16) whose bottom surface (92) includes an arcuate bottom area (100), and a stand assembly (14) which includes a pair of leg members (33), a top pivot subassembly (38), an actuator rod subassembly (40), and a foot pivot subassembly (42). The actuator rod subassembly (40) includes a pair of resilient wire arm members (80 and 82) connected via a "Y" connector (84) to a stiff rod member (78) whose length extends to the foot pivot subassembly (42). The "Y" design simultaneously provides for an instantaneous deployment of the leg members (33) upon tilting of the golf bag (12) forward while also eliminating the need for a supplemental spring or band for good retraction of the leg members (33) against the golf bag body (18). The foot pivot subassembly (42) includes a foot plate (88) which is hinged on the base member bottom surface (92) and which is sufficiently flexible to be able to conform itself to the arcuate bottom area (100). When the golf bag (12) is tipped forward, the golf bag (12) is able to "roll" upon both the bottom surface (92) and the foot plate (88) as the foot plate (88) is forced upward to drive the rod member (78). The rolling action provides an exceptionally smooth deployment of the leg members (33) and also causes the golf bag (12) to remain in continual contact with the ground and be more stable as it is tilted.

19 Claims, 7 Drawing Sheets

GOLF BAG STAND SYSTEM

TECHNICAL FIELD

The present invention relates generally to golf bags and more particularly to golf bags which include an integral stand with automatically deployable and retractable leg members.

BACKGROUND ART

It goes almost without saying that it is exceedingly inconvenient for a golfer to have to select golf clubs from an unsupported golf bag and to have to lay his or her golf bag directly upon the ground in between shot-making. Further, many individuals prefer, or in some circumstances are required, to carry their golf bag slung over the shoulder as opposed to transporting the clubs with the aid of a powered cart. Accordingly, there exist in the prior art a very large number of integral stand devices for supporting a golf bag at a conveniently tilted upright angle so that an easy selection, retrieval, and replacement of golf clubs may be made from therein.

While there exist such stand devices whose supporting legs are deployed other than by contact of an actuating structure located at the base of the golf bag with the ground (such as by hand deployment or by release of tension upon the carrying strap), actuation by contact with the ground has been the most prevalent technique employed in the prior art. Until very recently, the ground-actuated mechanisms utilized rigid pole members or flexible U-shaped spring arms the lowermost ends of which extended beyond the base of the golf bag. Upon placement of the bag upon the ground, the pole member or spring arms are driven upward, and being pivotally connected to the legs at some higher location, cause an outward deployment of the legs away from the golf bag. When the bag is raised from the ground, the legs automatically retract by virtue of a supplemental spring or elastic member which continually exerts a force to draw the legs against the bag.

The problem with stands of the immediately foregoing design is that if it is desired that the golf bag be positioned or stored upright, the legs will be automatically deployed and will therefore protrude inconveniently outward from the bag, which limits the space within which the bag can be stored and also creates an obstacle. Some of the prior art addresses the problem by providing supplemental means for deactivating the actuator mechanism, either in the form of a supplemental restraining part which must be separately carried or by a sliding adjustment mechanism which must be manipulated. Either of these solutions are inconvenient and unnecessarily add to the complexity of the device.

Only within the last few years have integral golf bag stands appeared which have overcome the previous limitations of ground-actuated mechanisms. Most notable is the present inventor's own invention which is shown and described in U.S. Pat. No. 5,415,285, issued 16 May 1995. In addition is the invention found in U.S. Pat. No. 5,152,483, issued 6 Oct. 1992 to Maeng. Both of these devices employ ground-operated actuators that incorporate a pivoting foot assembly at the base of the bag such that deployment of the legs only occurs when the bag is tilted forward with the foot pivot assembly in contact with the ground and not when the bag is simply standing in the straight upright position. In addition to this orientation-directed deployment method, the devices also require a minimum distance for the travel of the actuator components and thus have a desirable "quick action" feature.

Although it will be seen that a large number of different golf bag stand devices have been produced and introduced into the market place, substantial room remains for innovation in the field. A common and on-going desire has been to simplify the structures which comprise the leg actuator components, not only to improve the aesthetic appearance of the bag but to lessen the susceptibility of the actuator components to wear, breakage, or even loss.

In particular, the previously known stand devices of both the inventor and Maeng require that a supplemental elastic member or spring be used to provide for the automatic retraction of the legs against the bag body. In the case of Maeng, the U-shaped flexible arms that are employed have a certain amount of spring-like character in themselves which acts to draw the legs inward to a certain extent, but the length of the arms are such that the spring action is weak and an auxiliary "rubber band" must be employed. From the points of view of both simplicity of operation and repair, and for elegance of appearance, it would be desirable to eliminate the need for any such supplemental retraction aid.

One piece, U-shaped steel spring mechanism designs, such as Maeng, have an inherent disadvantage: if the spring is made stiff enough to push the legs outward instantaneously without significantly yielding or lagging, then it provides too much retraction ("squeezing") action such that it requires a great force to overcome. Further, because long grass, soft ground, and hills can all impede the action of the legs, it is important to have instantaneous activation of the legs. The springs of currently available mechanisms momentarily flex before they began to push the legs out. During this time, the golf bag has been tipped farther forward to a position at which the legs are likely to find interference from the grass or hill.

Finally, with respect to known golf bag stands, the pivoting transition from the fully retracted leg state into the initial start of deployment is only incidentally leveraged and only minimal concern appears to have been taken to enhance the ease with which that transition may be entered.

Because of the limitations associated with presently available integral stand devices, a substantial need still exists for such a device as is operationally more efficient and also more simple in design.

DISCLOSURE OF THE INVENTION

Accordingly, it is an object of the present invention to provide a golf bag stand system that provides for highly efficient automatic deployment and retraction of the supporting leg members.

It is another object of the invention to provide a golf bag stand system which is simple in design and construction.

It is a further object to provide a golf bag stand system which utilizes a Y-shaped actuator member in which a stiff rod member and spring arm members are combined.

It is yet another object to provide a golf bag stand system in which the base of the golf bag has a sloped or curved base member for minimizing inhibition of transition from mode to mode.

It is yet a further object of the present invention to provide a golf bag stand system which has a restricted profile in the retracted mode.

Briefly, the preferred embodiment of the present invention is a stand system for golf bags which provides an automatic leg deployment and retraction capability and which offers an exceedingly smooth and efficient operation and design. The preferred embodiment is directed toward soft-sided golf bags but is generally applicable to any golf bag. The stand system has the primary components of a generally conventional golf bag, but one which has a specially designed base member whose bottom surface includes an arcuate bottom area that has been contoured to curve upwards to the front (stand side) of the golf bag, and a stand assembly which includes a pair of leg members, a top pivot subassembly, an actuator rod subassembly and a foot pivot subassembly.

The most general concept by which the stand system operates is a well known one. Thus, tilting the golf bag forward upon the ground causes an upward force from the ground to be exerted upon the foot pivot subassembly which in turn causes an upward movement of the elements of the actuator rod subassembly such that an interface of the leg members therewith causes the leg members to pivot about the top pivot subassembly and to be rotated forward and outward into a stable tripod stand configuration. Tension exists within the actuator rod subassembly such that when the golf bag is then reoriented toward the vertical or lifted from the ground, the leg members are caused to retract. While the foregoing concept is a conventional one, the structure of the components as implement the concept are not and they represent a great improvement over the prior art in several aspects as follows.

The actuator rod subassembly includes a pair of wire arm members whose length has been rather greatly abbreviated, relative to prior art arm member actuators, through the use of a conjoined push rod or rod member whose length extends to the foot pivot subassembly. The conjoined, Y-shaped design provides that a sufficiently great biasing force is achieved when the arm members are spread such that the leg members are retracted and held against the golf bag without the need for any additional spring or elastic member, as is necessary with prior art devices where the resilience of the arm members employed has been impaired due to their length. At the same, an instantaneous deployment of the leg members is obtained.

The foot pivot subassembly includes a foot plate which is hinged on the bottom surface of the base member of the golf bag and which is sufficiently flexible to be able to conform itself to the arcuate bottom area. Thus, when the golf bag is tipped forward, it is able to "roll" upon both the bottom surface and the foot plate as the foot plate is forced upward to drive the rod member. This rolling action provides an exceptionally smooth deployment of the leg members and also causes the golf bag to be more stable as it is tilted, since at least some portion of the base member is then always in contact with the ground, as compared to prior art devices whose pivoting feet members and flat-bottomed golf bag bases require that the golf bag has to pivot up off of the ground and onto the foot member during the tilting process with an inherent loss of stability thereby.

An advantage of the present invention is that the inherently strong spring force generated by the shorter wire arm members of the Y-shaped actuator mechanism requires that no supplemental spring device need be used to achieve sufficient retraction of the leg members against the golf bag body.

Another advantage of the invention is that the push rod member aspect of the Y-shaped actuator mechanism allows for an immediate, highly directed force to be transmitted to the leg members for a more efficient deployment operation, i.e., instantaneous activation of the leg members without any flex lag.

A further advantage is that the prebiased nature of the base member increases the efficiency of the tilting operation.

Yet another advantage is that the sloped golf bag base member provides that a broad, continual contact of the base member with the ground during the tilting operation is maintained to greatly lessen the chance of the golf bag falling over to one side.

Yet a further advantage is that the roller bottom base member and conformable foot member provide for a smooth, non-jerky deployment of the leg members.

Still another advantage is that the leg members are maintained against the bag body when the golf bag is in the vertical mode to facilitate ease of storage.

A still further advantage is that the components as comprise the stand system are tightly compact in the vertical storage mode and minimally removed from the golf bag body when in the deployed stand mode resulting in a minimized profile in both the storage and deployed modes Yet another advantage of the present invention is that, except for the leg members when deployed, all of the components remain very close to the bag body during operation, resulting in economy of operation.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
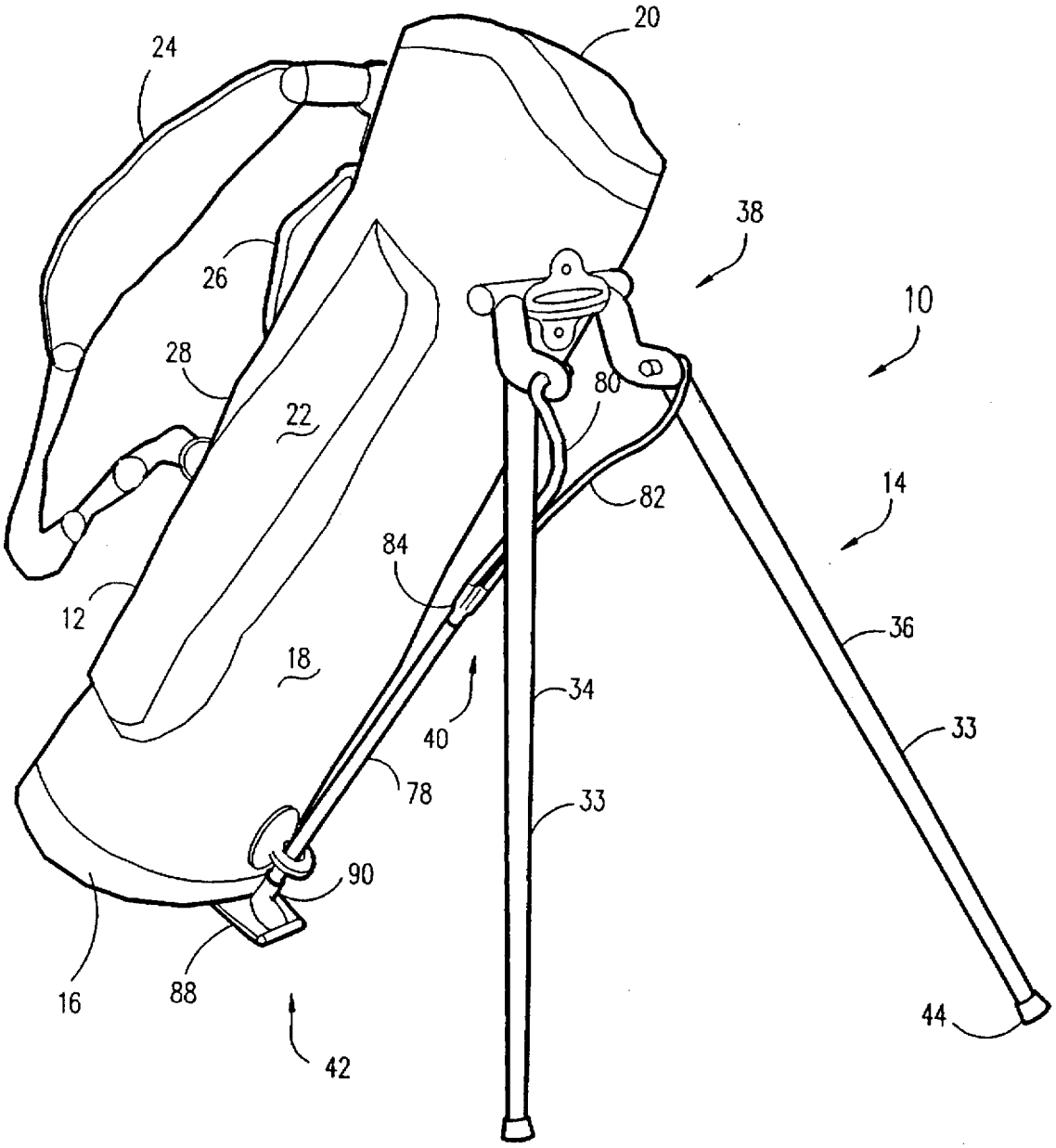
FIG. 1 is a perspective view of the preferred embodiment of the present invention, shown in stand mode.

The preferred embodiment of the present invention is an integral stand system for golf bags. The stand system of the preferred embodiment is directed toward use with a golf bag of the so-called "carry bag" or "soft-sided" type and such is set forth in FIG. 1, wherein the stand system is designated by the general reference character 10.

Referring to the perspective view in FIG. 1 of the drawings, the stand system 10 includes a golf bag which is indicated in its entirety by the reference numeral 12. The stand system 10 further includes a stand assembly which is indicated in its entirety by the reference numeral 14. Except for a uniquely designed base member 16 (described in detail below), the golf bag 12 is substantially conventional in nature. In addition to the base member 16, the golf bag 12 includes a tubular fabric golf bag body 18 and a rigid throat structure or collar member 20. The golf bag 12 also includes the various other accessories as are normally associated with golf bags such as pockets 22, a shoulder strap 24 and a carrying handle 26.

For purposes of convenience of description, the golf bag 12 is designated as having a "spine" or rear portion 28 and a front portion 30. The shoulder strap 24 and carrying handle 26 are attached along the rear portion 28, while the stand assembly 14 is attached along the front portion 30.

Figure 2:
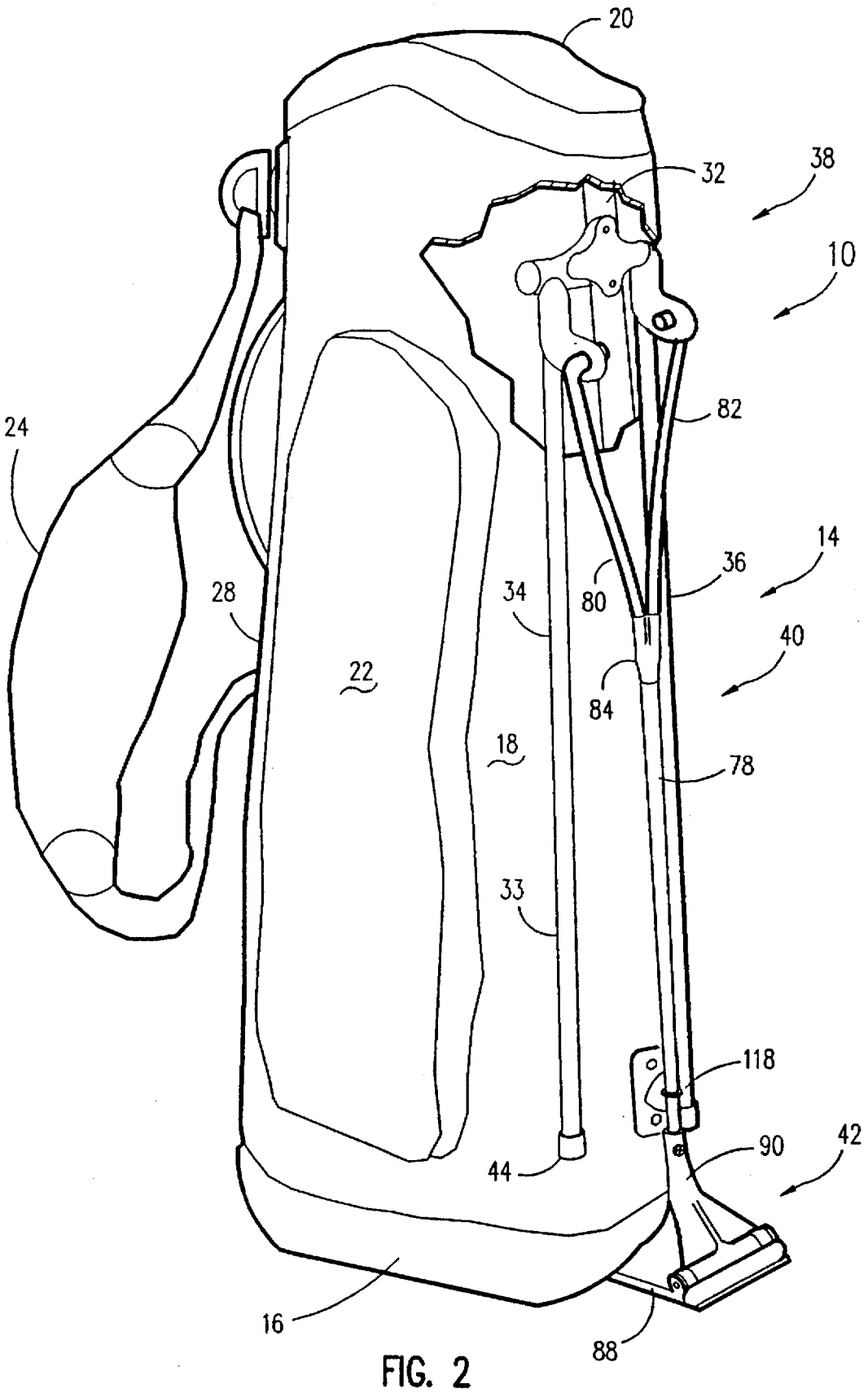
FIG. 2 is a partially cut-away perspective view of the embodiment of FIG. 1, shown in storage mode.

Referring now also to the partial cut-away view of FIG. 2, in order to maintain longitudinal rigidity so that golf clubs (not shown) may be properly contained, the golf bag 12 is provided with a rigidifying strut 32 which extends along the front portion 30 from the base member 16 to the collar member 20. Such a strut 32 is conventional to golf bags generally and may be located either outside the body 18 or, more aesthetically, just within the body 18 as is shown. The preferred golf bag 12 is also provided with a one or more support rods (not shown) which provide longitudinal rigidity along the rear portion 28 in an analogous fashion to the strut 32. The strut 32 and base member 16 provide the actual sites of attachment for the stand assembly 14, the nature of which will hereinafter be described in more detail.

The stand assembly 14 includes a pair of leg members 33, including identical left and right leg members 34 and 36, respectively, and three subassemblies. These are a top pivot subassembly 38, an actuator rod subassembly 40, and a foot pivot subassembly 42. Each of the subassemblies (38, 40, and 42) has an axis of symmetry defined by the strut 32, that is, the subassemblies (38, 40, and 42) are symmetrical at points to the left and right of the strut 32. Together with the leg members 33, the subassemblies (38, 40, and 42) cooperate to create the operational stand assembly 14.

The leg members 33 are rod-like structures of a reasonably rigid nature. The lower end of each of the leg members 33 is provided with a rubber cap 44 as is commonly employed for such leg structures to enhance the support capabilities of the leg members 33 on a wide variety of surfaces. The upper end of each the leg members 33 insertably interfaces with the top pivot subassembly 38, as will be seen below. In the preferred embodiment, the leg members 33 are formed from a high strength, light weight material such as a tubular fiberglass or aluminum alloy.

Figure 3:
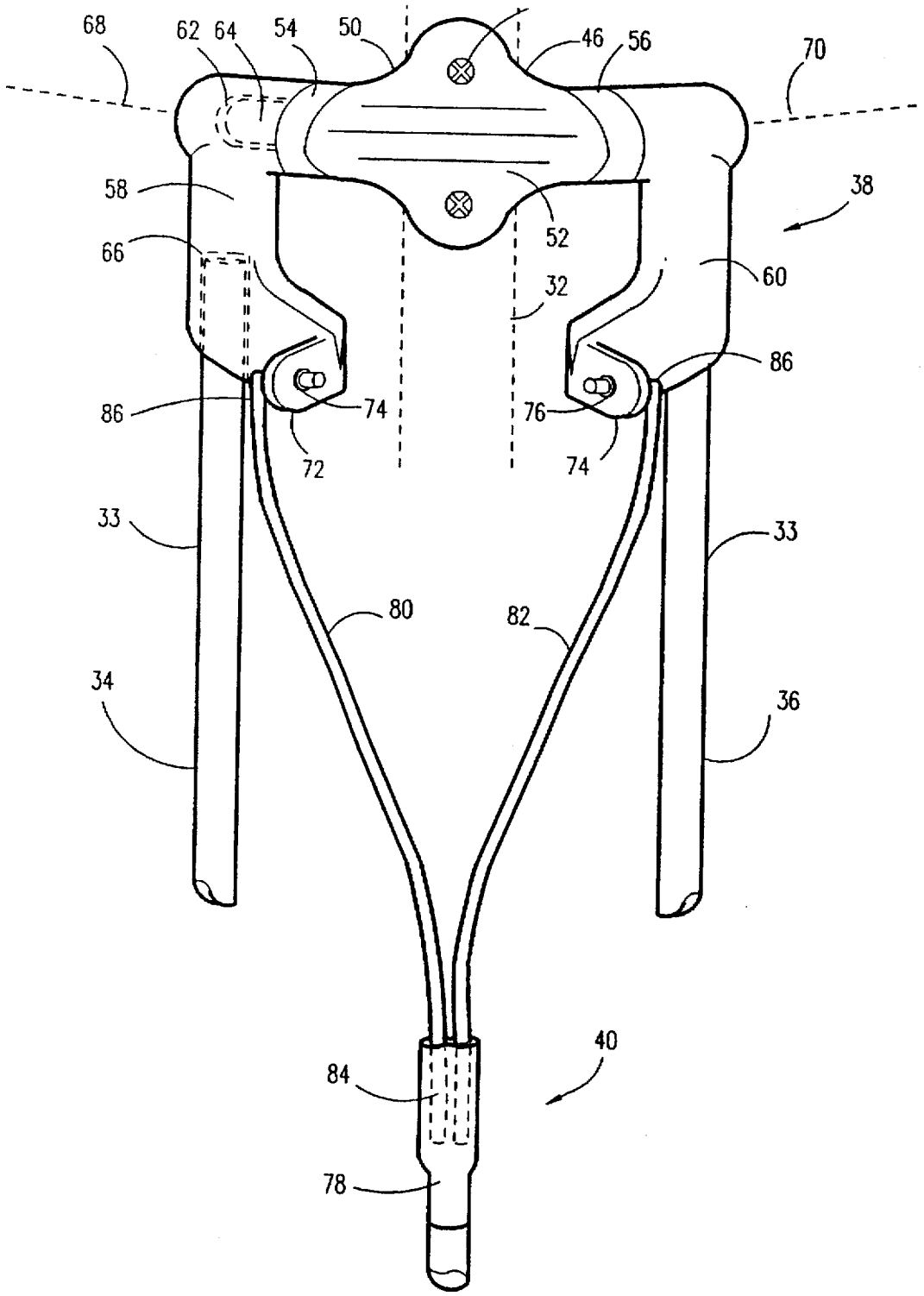
FIG. 3 is a front perspective view of the top pivot subassembly and upper half of the actuator rod subassembly, shown in storage mode.
Figure 4:
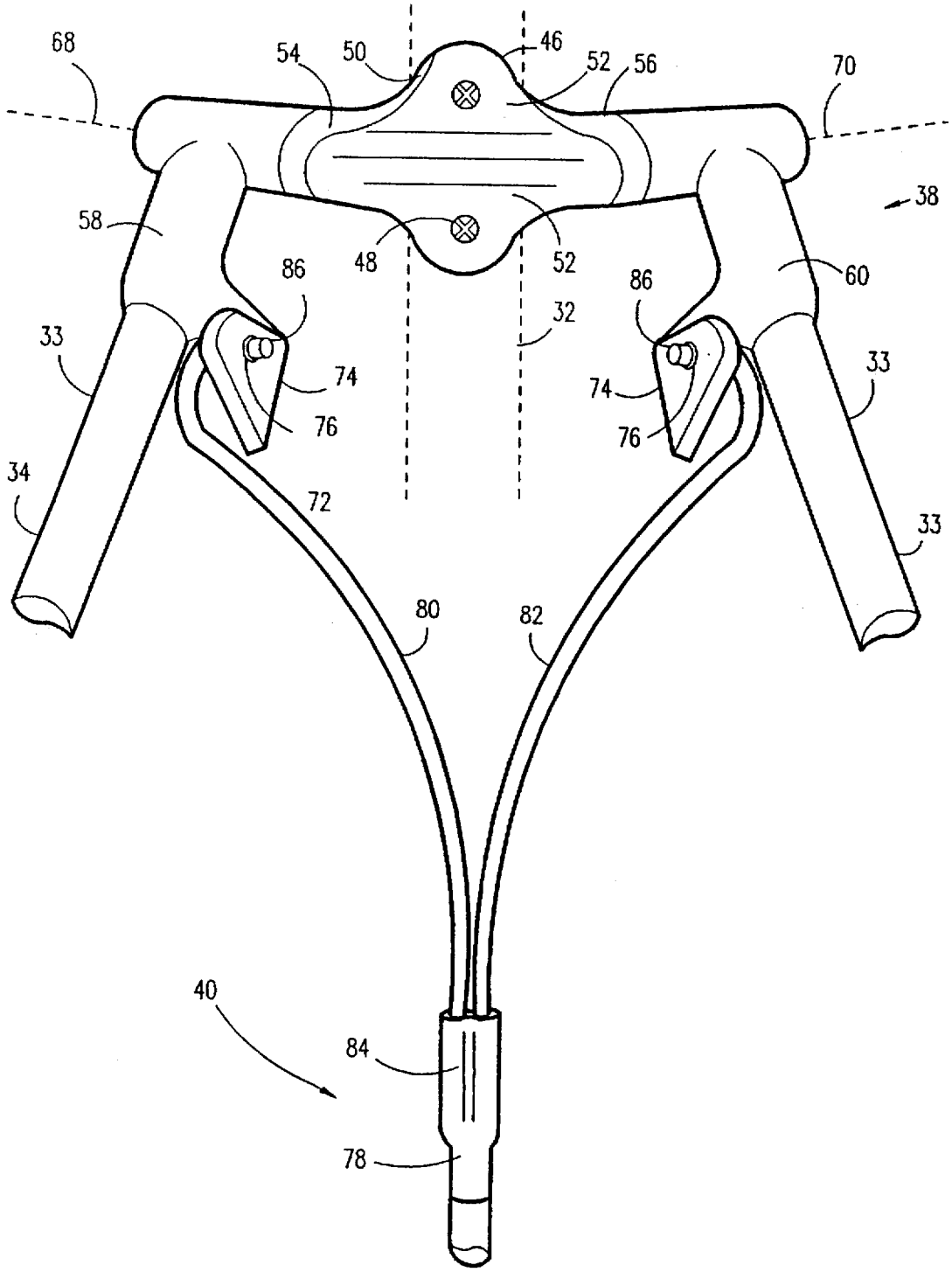
FIG. 4 is a front perspective view of the same components of FIG. 3, shown in stand mode.

The top pivot subassembly 38 is particularly illustrated in FIGS. 3 and 4. In these illustrations, the interrelationship between the top pivot subassembly 38, the leg members 33, and the actuator rod subassembly 40 is demonstrated. The top pivot subassembly 38 includes what is denoted herein as a "wing block" 46. The wing block 46 is a strong rigid member which is securely attached to the strut 32 in such a manner that the wing block 46 is held in firm constant orientation upon the front portion 30 of the golf bag. In the preferred embodiment the method of attachment includes mechanical fasteners in the form of screws 48. Some additional stabilization is provided by the wing block 46 being formed with a back face that includes a shallow vertical channel 50 having a width that is just slightly larger than that of the strut 32 (i.e., were the screws 48 not present, the wing block 46 could be slid along the strut 32 in guidable fashion by virtue of the channel 50). The wing block 46, and various components of the top pivot subassembly 38 as will be described, are preferably made from a high strength structural plastic or similar material.

The wing block 46 includes a central portion 52 (through which the aforementioned attachment to the strut 32 is made) and a pair of opposed left and right wing portions 54 and 56 which are angled rearward from the central portion 52 at angles of approximately twenty-five degrees. The central and left and right wing portions (52, 54, and 56) together create a structure that follows the curvature of the body 18 of the golf bag 12 in relatively tangential fashion to give both a sleek appearance to the top pivot subassembly 38 and, moreover, as will be seen below, a proper orientation for the deployed leg members 33.

The top pivot subassembly 38 further includes a pair of left and right leg member connectors 58 and 60. Each of the leg member connectors (58 and 60) includes a pivot bore 62 for receiving wing posts 64 which, in the preferred embodiment, comprise a major extent of each of the left and right wing portions (54 and 56). The fit of the pivot bores 62 upon the wing posts 64 is one that permits free rotation of the pivots bores 62 about the wing posts 64. No special mounting aids are required to maintain a connection between the pivot bores 62 and wing posts 64, since a secure interface is maintained by the nature of the forces exerted by the actuator rod subassembly 40 upon the top pivot subassembly 38, as will be seen below. It will be apparent that the respective associations of the pivot bores 62 and wing posts 64 with the leg member connectors (58 and 60) and the wing portions (54 and 56) might be reversed without disruption of function. That is, the leg member connectors (58 and 60) might include posts for pivoting and the wing portions (54 and 56) could then include bores for reception of those posts.

Each of the leg member connectors (58 and 60) also includes a leg member bore 66, which are oriented orthogonally to the pivot bores 62, for insertable reception of the leg members 33. The reception is made secure by use of a strong adhesive and/or mechanical fasteners. The top pivot subassembly 38 thereby provides the mechanism by which the leg members 33 are able to rotate between a retracted position or "storage mode" (FIGS. 2 and 3) to the deployed position or "stand mode" (FIGS. 1 and 4), and vice versa.

The orientation of the left and right wing portions (54 and 56) relative to the central portion 52, and particularly the orientation of the wing posts 64 with respect to the central portion 52, provides for a left pivot axis 68 associated with the left wing portion 54 and left leg member 34 and a corresponding right pivot axis 70 which is associated with the right wing portion 56 and right leg member 36. The pivot axes (68 and 70) are coplanar and, again, in the preferred embodiment, are each oriented at an angle of about twenty-five degrees from a plane tangential to the front portion 30 of the golf bag body 18, or about one hundred-thirty degrees with respect to each other. This angular configuration provides that the leg members 33 are not only caused to rotate forward from the body 18 but also to rotate outward such that the lower ends of the leg members 33 are much farther apart with respect to one another than when in the storage mode.

At the bottoms of each of the left and right leg member connectors (58 and 60) there is further provided a left and right rocker arm 72 and 74, respectively. The rocker arms (72 and 74) are integrally fashioned projections each of which have a small diameter rocker arm bore 76 associated therewith. The orientation of the rocker arms (72 and 74) are such that the respective rocker arm bores 76 achieve axial alignments that are identical with the pivot axes (68 and 70). The rocker arms (72 and 74), and more particularly the rocker arm bores 76, provide the points at which force transmission from the actuator rod subassembly 40 to the top pivot subassembly 38 occurs, with consequent rotation of the leg members 33, as is described hereinafter.

The actuator rod subassembly 40 includes a rod member 78, a pair of left and right arm members 80 and 82, respectively, and a "Y" connector 84. The rod member 78 is essentially a smaller diameter version of the leg members 33 and is made from the same sorts of materials. The arm members (80 and 82) are flexible, heavy gauge spring metal wires the top ends of which have been bent inwardly toward one another in somewhat of a hook-like fashion to form an arm crook 86.

The "Y" connector 84 is adapted to be securely mounted to the top of the rod member 78 and further to securely receive the lower ends of each of the left and right arm members (80 and 82). The rod member 78 and the arm members (80 and 82) are thus disposed in a conjoined linear relation to one another. In the preferred embodiment, the rod member 78 and arm members (80 and 82) comprise roughly one-third and two-thirds of the overall length of the actuator rod subassembly 40, respectively. Although other relative lengths may be employed, the inventor has found that this ratio best fulfills the purposes of the conjoined configuration, as will be described in the following.

During assembly, the arm members (80 and 82) are springingly spread apart to yield a "V" shaped state of configuration and the arm crooks 86 are inserted into the rocker arm bores 76. When the arm members (80 and 82) are so spreadably connected, a force is created by which each of the left and right leg member connectors (58 and 60) are caused to be biased toward one another and thus to be securely retained upon the left and right wing portions (54 and 56), respectively. This same biasing force also aids in pulling the leg members 33 toward the body 18. Due to the relatively short length of the arm members (80 and 82), the force is much greater than is capable of being achieved from prior art "U" configured wire arm members as have gone heretofore and whose length is the entirety of the actuating member employed.

As is illustrated in the comparison of FIGS. 3 and 4, the connection between the arm members (80 and 82) and the rocker arms (72 and 74) provides that an upward motion of the rod member 78 and, correspondingly, the conjoined arm members (80 and 82), causes a forced rotation of the leg members 33 from the storage mode to the extended stand mode. That is, when the arm members (80 and 82) move upward, the arm crooks 86 apply an upward force within the rocker arm bores 76 to cause the leg member connectors (58 and 60) and the attached leg members 33 to be rotated about the pivot axes (68 and 70). The upward transition of the leg member connectors (58 and 60) is assisted by the fact that the rocker arm bores 76 are formed within the rocker arms (72 and 74) at locations that are slightly farther removed from the body 18 than is the axis defined by the rod member 78 (and the lower ends of the arm members (80 and 82)). In addition, the arm crooks 86 are permitted to rotate within the rocker arm bores 76, and the rocker arm bores 76 about the arm crooks 86.

As an upward motion to the actuator rod subassembly 40 is applied, it will be seen that an additional spreading apart and bending of the arm members (80 and 82) occurs as the leg members 33 rotate outward and forward. Thus, when in the stand mode, the biasing force as between the arm members (80 and 82) is magnified as the resilient arm members (80 and 82) are further deformed from the straight, preassembly conformation. Again, due to the short length of the arm members (80 and 82) employed relative to the overall length of the actuator rod subassembly 40, this spring-like effect is much greater than is capable of being achieved from prior art, full length "U" configured wire arm members. Therefore, no additional spring component is required to cause a sufficiently strong automatic retraction of the leg members 33 (and a correspondingly downward movement of the actuator rod subassembly 40) when desired. It will be noted that a similar spring strength could be obtained in the case of the much longer prior art wire arm members were those arm members are made of a larger diameter wire, but in that case the force necessary to bend the arm members during transition to the stand mode would be so large as to require a very great exertion during deployment. It is apparent that materials other than metals, including combinations of metals and other materials, might be used for the arm members (80 and 82) where those materials exhibit the desired resiliency for employment within the novel conjoined "Y"-shaped actuator rod subassembly 40 of the present invention.

An additional benefit of the conjoined, "Y" shape design of the actuator rod subassembly 40 is that the interface of the actuator rod subassembly 40 with the foot pivot subassembly 42 (described below), is with a single member, namely, the lower end of the rod member 78. This provides that a single, directed force transfer point is initially obtained upon carrying out deployment of the leg members 33 (the manner of operation is also described below), unlike prior art "U" configured wire arm members as have gone heretofore and, again, whose length is the entirety of the actuating member. In such prior art "U" shaped devices, contact with the ground (or foot member, if employed) means that, effectively, two (smaller) points of force transfer result which are less controllable and less efficient in directing force upward to spread any leg members apart. The design of the actuator rod subassembly 40 also imparts a certain aesthetic appeal since it imparts a sleeker, more simple appearance to the golf bag 12.

Thus, it will be evident that in the present invention, as opposed to the known prior art, the pushing function of the lightweight rod member 78 is simultaneously both separate and united with the springing action of the arm members (80 and 82). The stiff rod member 78 is able to push instantaneously without yield or lag, thereby maximizing pushing efficiency during actuation, while the abbreviated arm members (80 and 82) provide that the "squeezing" and retracting function is maximized without introducing excess weight or excess spring force into the actuator rod subassembly 40.

The manner in which the upward motion of the actuator rod subassembly 40 is achieved is by the relative motion of the foot pivot subassembly 42. This is illustrated in the depictions of FIGS. 5 and 6, which show the lower portion of the stand system 10 in the storage mode (corresponding to FIGS. 2 and 3) and the stand mode (corresponding to FIGS. I and 4), respectively.

Figure 5:
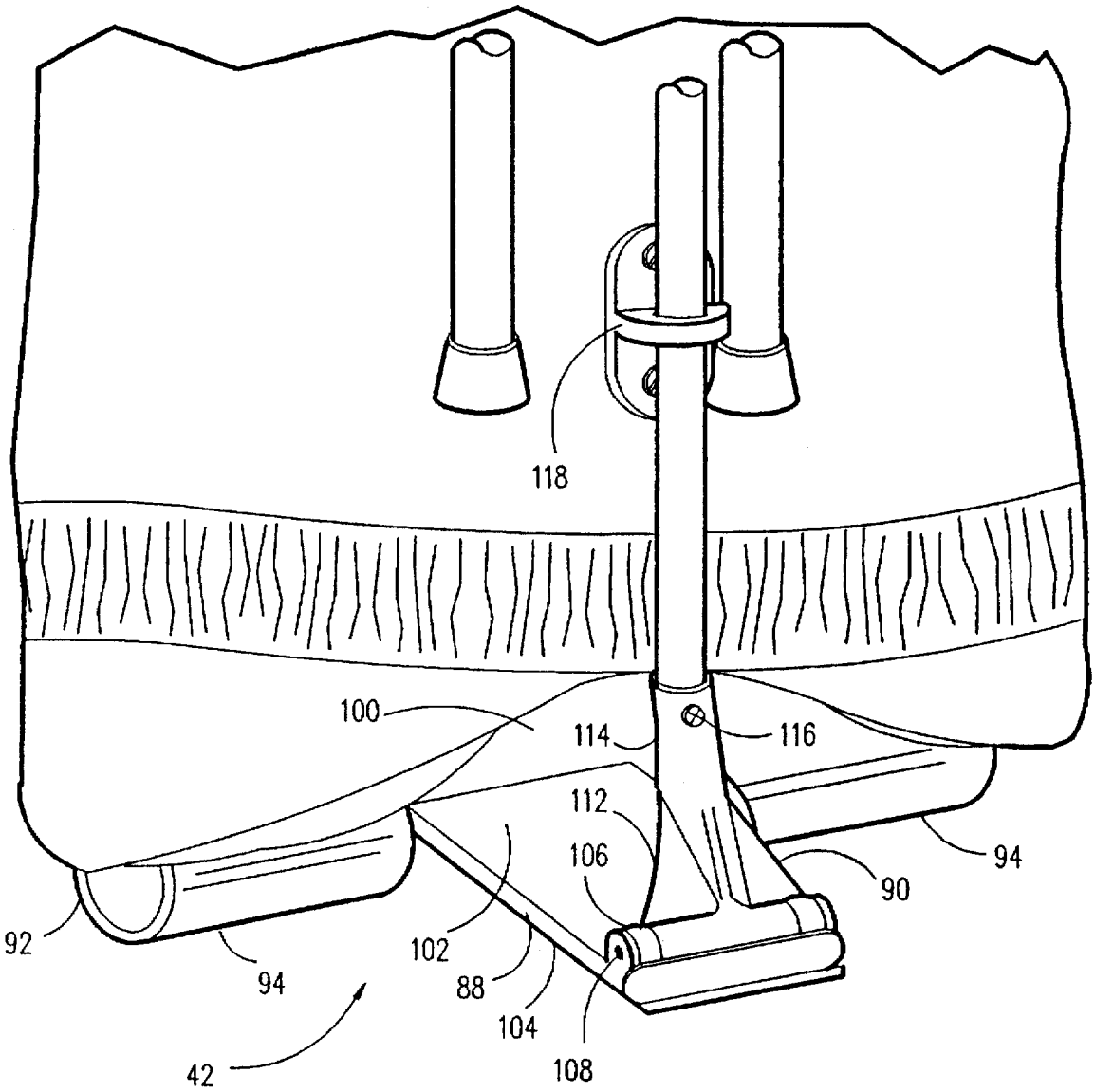
FIG. 5 is a perspective view of the bottom pivot subassembly and base member, shown in storage mode.
Figure 6:
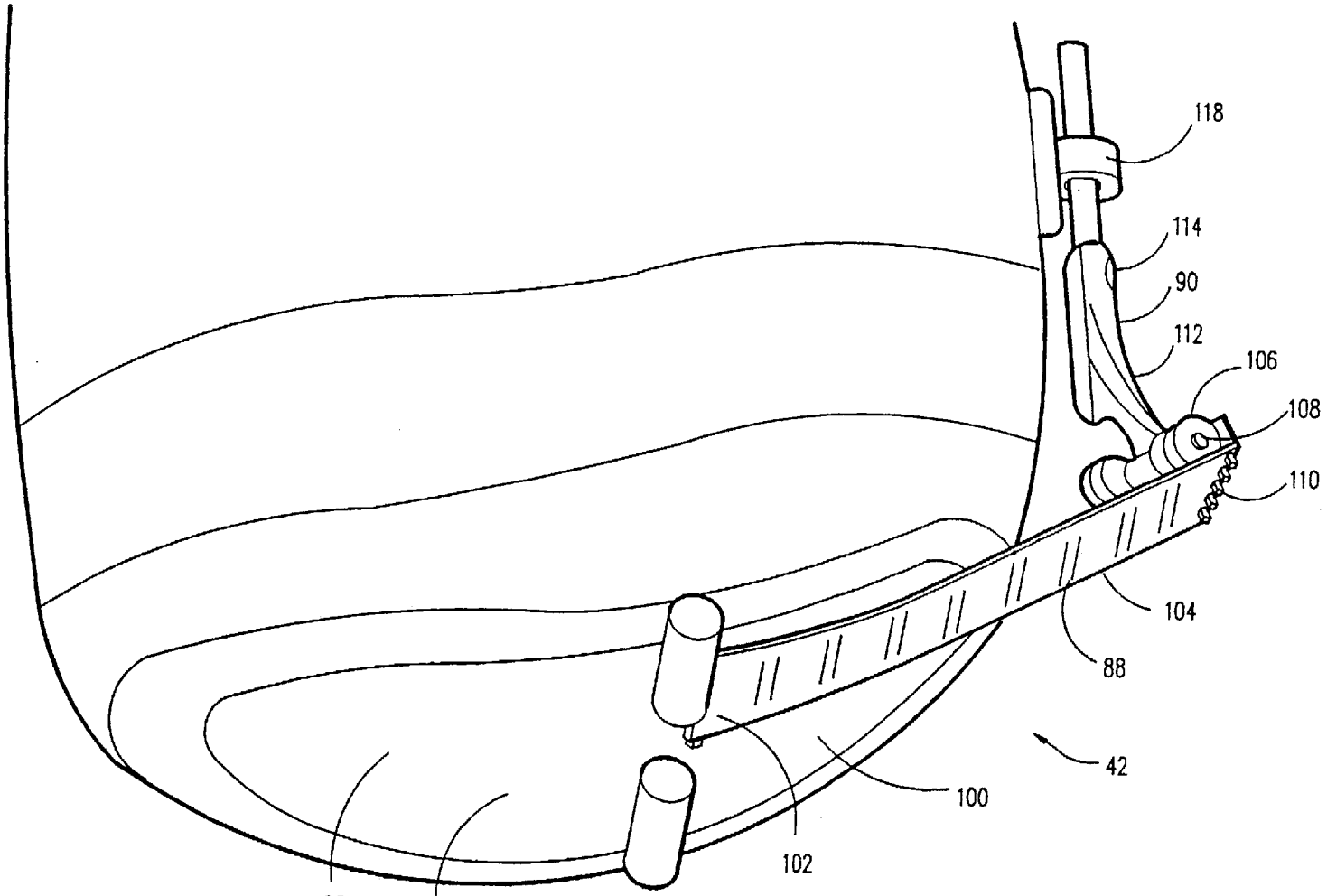
FIG. 6 is a side perspective view of the components of FIG. 5, shown in stand mode.
Figure 7:
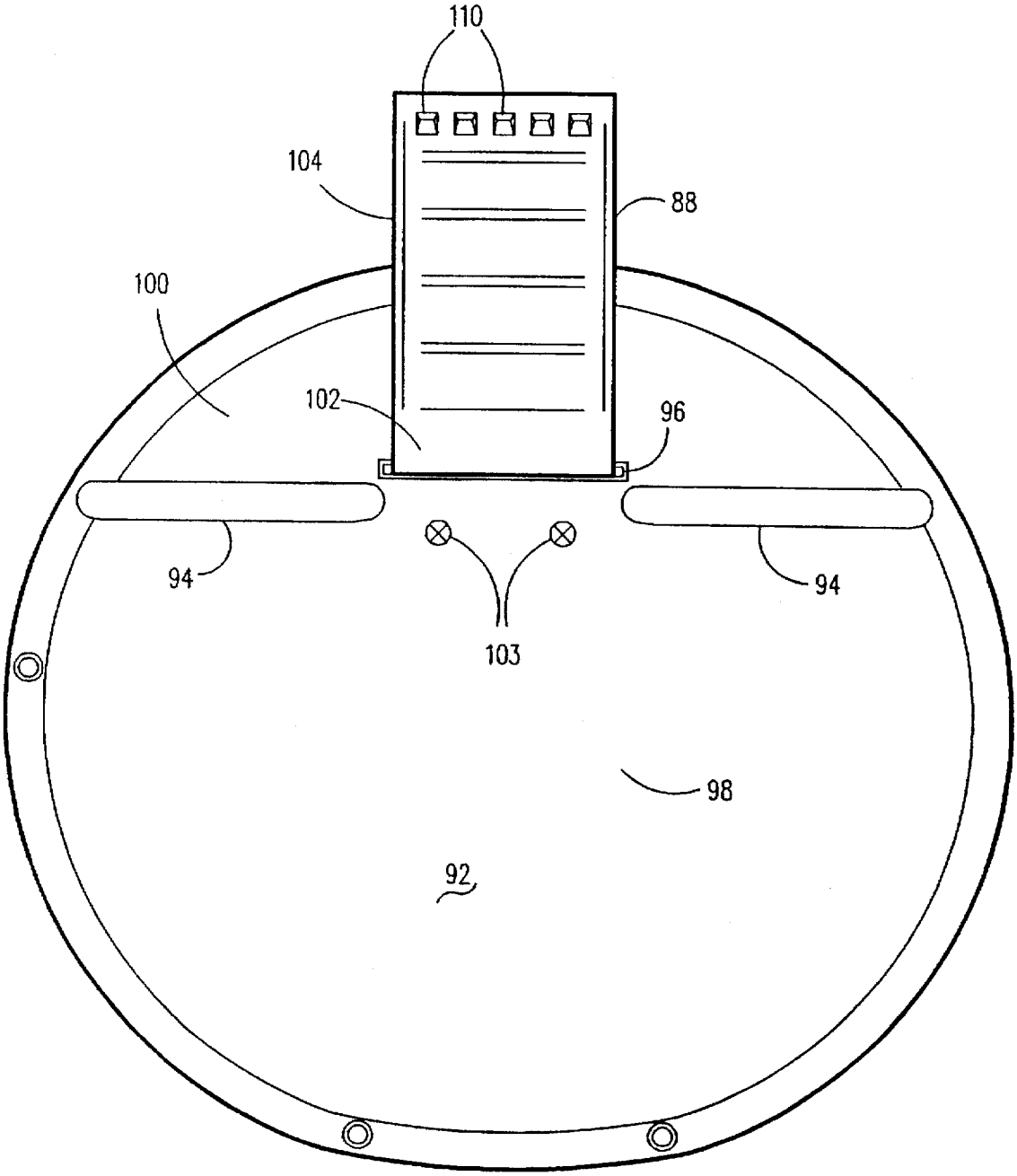
FIG. 7 is a bottom elevational view of the base member and bottom pivot subassembly.

As may be seen from the illustrations of FIGS. 5 and 6, and now also referring to the bottom view of FIG. 7, the major elements of the foot pivot subassembly 42 include the aforementioned uniquely designed golf bag base member 16, a foot plate 88 which is hingedly attached to the golf bag base member 16, and a rod member connector 90 which is in turn hingedly attached to the foot plate 88. The rod member connector 90 provides the direct interface with the actuator rod subassembly 40.

The base member 16, which in the preferred embodiment has a somewhat egg-shaped circular cross-sectional shape, includes a bottom surface 92, a pair of stabilizer supports 94, and a hinge slot 96 which is located between and just forward of the stabilizer supports 96. In the preferred embodiment, each of the bottom surface 92, stabilizer supports 94, and hinge slot 96 are integrally molded features of the base member 16. With references being made to the orientation of the called-out components when the golf bag 12 is in the upright or storage mode, it is seen that the bottom surface 92 includes a substantially horizontally disposed flat bottom area 98 which extends from the rear portion 28 of the golf bag 12 to the stabilizer supports 94. The bottom surface 92 further includes an arcuate bottom area 100 which curves gradually upward in arcuate inclined fashion from the stabilizer supports 94 to the front portion 30 and whose function will be described shortly.

The stabilizer supports 94 thus present a demarcation between areas of the bottom surface 92 which have differing elevational aspects with respect to the ground when the golf bag 12 is standing upright. The stabilizer supports 94 are in the form of rounded ridge or bar-like structures located upon the bottom plate 92 and are oriented in transverse fashion between the front and rear portions (30 and 28). The stabilizer supports 94 provide that the golf bag 12 will be biased toward a substantially vertical standing position. In fact, the stabilizer supports 94 actually cause the golf bag 12 to stand very slightly inclined from the perfectly vertical toward the direction of the rear portion 28. Thus, the golf bag 12 will not be prone to fall forward in the direction of the arcuate bottom area 100 when upright storage is desired. The stabilizer supports 94 also function to provide some amount of traction for the base member 16 upon the ground as the golf bag 12 is tilted during the deployment process, as will be described.

The foot plate 88 is a thin, generally rectangular flexible member which has a tab end 102 for attachment within the hinge slot 94 which, as the designated name implies, is simply a narrow rectangular aperture fashioned in the bottom surface 92 of the base member 16. The tab end 102 is an offset extension of the main body of the foot plate 88 which is sized for insertion within the hinge slot 94. The tab end 102 is securely fastened within the hinge slot 94 with screws 103 that extend through both the bottom surface 92 and the inserted portion of the tab end 102. The described attachment provides that the tab end 102 becomes a flexible hinge for the foot plate 88. The foot plate 88 itself is sufficiently flexible to be capable of closely conforming to the curvature of the arcuate bottom area 100. The ability of the foot plate 88 to so conform promotes a smoother and more stable tipping action of the golf bag 12 and a correspondingly smoother and less effort intensive extension of the leg members 33—in addition to other major advantages relative to the prior art, as will be seen below.

It will be apparent that while the particular insertable tab arrangement illustrated is especially well suited for permitting full conformability of all of the foot plate 88 as resides within the perimeter of the base member 16, other attachment methods would enable at least some, if not most, of the advantages conferred by the foot pivot subassembly 42. Such attachment methods may even include foot plates 88 as are an integrally fashioned part of the base member 16, although it is desirable for the components of the present invention to be easily replaceable if necessary.

The foot plate 88 further includes a distal end 104 which extends beyond the arcuate bottom area 100 and front portion 30 of the golf bag by several centimeters. On the upper surface of the distal end 104 are located a pair of hinge posts 106 which support a hinge pin 108 therebetween. The undersurface the distal end 104 is provided with gripping spikes 110 to provide extra traction with respect to the ground during deployment of the leg members 33, since a good deal of the force exerted by the golfer upon the stand system 10 during such deployment is concentrated on the distal end 104 of the foot plate 88. When in the upright storage mode, the distal end 104 aids in balancing the golf bag 12 to a certain extent since the foot plate 88 is forced downward by the actuator rod subassembly 40 to a (flexed) position such that the gripping spikes 110 are in contact with the ground (the other points of balance being the stabilizer supports 94 and the rear portion of the bottom surface 92 of the base member 16). The foot plate 88 of the preferred embodiment is formed of a plastic sufficiently flexible, as noted, to conform to the arcuate bottom area 100 and sufficiently durable to undergo repetitious flex-hinge movements.

The rod member connector 90 is adapted to be pivotally mounted between the hinge posts 106 and to rotate on the hinge pin 108. The rod member connector 90 is further provided with an angular extension piece 112 that extends backward from the distal end 104 at an angle of approximately seventy-five degrees to be integrally joined with a rod member receiver 114. The rod member receiver 114 is a substantially vertically oriented closed-end bore that receives the lower end of the rod member 78. A friction screw 116 provides that the rod member 78 is held tightly within the rod member receiver 114. The offset provided by the angular extension piece 112 yields at least the result of obtaining a leveraged force point at the distal end 104 of the foot plate 88 even while a close and substantially vertical relation of the rod member 78 to the golf bag body 18 is maintained.

Near the bottom of the golf bag 12, close to the base member 16, and fixedly attached to the strut 32 on the front portion 30 is a retainer ring 118. The lower portion of the rod member 78 is slidably inserted within the retainer ring 118 to provide that side loads to the actuator rod subassembly 40, or to the foot pivot subassembly 42, do not cause damaging deformation to the arm members (80 and 82) or other components of the stand system 10. In the case of airline travel especially, the retainer ring 118 greatly increases the durability of the actuator rod subassembly 40. (Since the motion generated by the stand assembly 14 causes the rod member 78 to move only in a substantially linear axial fashion, no significant force is delivered to the retainer ring 118 during actual operation.) The manner in which the foot pivot subassembly 42 functions is shown in the comparison of FIGS. 5 and 6. In the storage or carry mode of FIG. 5, the biasing force exerted by the left and right arm members (80 and 82) act to push downward upon the conjoined rod member 78 so that the distal end 104 of the foot plate 88 is in an extended lowest position, which, as noted previously, is a support-aiding ground contact position when the golf bag 12 is resting substantially vertically upon the ground. The extent that the foot plate 88 travels downward is limited by the left and right leg members (34 and 36) abutting against the golf bag body 18 and by the resilience of the flexibly hinged foot plate 88. It is a significant convenience that the leg members 33 are fully retracted not only when the golf bag 12 is being carried, but when vertical storage is desired as well.

When it is desired that the golf bag 12 be placed in the stand mode of FIGS. 1, 4, and 6, the golfer will set the golf bag 12 on the ground and tip the bag 12 forward. As the golf bag 12 is tilted forward, an upward force from the ground is exerted on the distal end 104 of the foot plate 88. This force causes the rod member connector 90 and the joined rod member 78 to be forced upward as well. The upward force overcomes the biasing force of the arm members (80 and 82) causing the arm crooks 86 to exert a pivotal force on the leg members 33 via the rocker arms (72 and 74), leg member connectors (58 and 60), and wing block 46 as previously described. The ability of the rod member connector 90 to rotate upon the hinge pin 108 assists in an efficient transfer of force to the arm members (80 and 82) by allowing the rod member 78 to move forward as the arm members (80 and 82) are forced to move forward and spread outward.

Unlike all "foot" implemented stand devices as have gone before, the arcuate bottom area 100 and the flexible foot plate 88 permit the base member 16, or more particularly, the bottom surface 92, to remain in contact with the ground at all times as the golf bag 12 is tilted. The inventor has coined the term "roller bottom" to describe the effect achieved. Thus, as the bag 12 is tipped forward, the foot plate 88 conforms to the convex shape of the arcuate bottom area 100 to permit a rolling action of the arcuate bottom area 100 upon the ground. This rolling action keeps at least one point of the bottom surface 92 in contact with the ground at all times to maintain a tripod configuration at all times during the tilting/leg deployment process. On very hard ground surfaces, a good portion of the ground contact time during the rolling action will occur upon the stabilizer supports 94, but this does not negate the smooth (or stabilized) action conferred by the conformation of the foot plate 88 to the arcuate bottom area 100 during the tipping of the golf bag 12.

It will be noted that, even without an arcuate aspect to the inclination presented by the bottom surface 92 of the preferred embodiment, that is, with just a straight angle of inclination, the attachment of the foot pivot subassembly 42 in conjunction therewith provides for a smoother and more efficient deployment of the leg members 33 as compared to prior art ground-deployment mechanisms. A non-curved inclination still gives a prebiased effect for ease of tipping the golf bag 12. A non-curved inclination also still permits a continual contact of a wider portion of the bottom surface 92 with the ground during the tilting operation since the tilting will occur upon one or more areas of the bottom surface 92 located near the base or lower end of the inclination (i.e., where the stabilizer supports 94 and tab end 102 of the foot plate 88 are located in the preferred embodiment).

By contrast, in the case of prior art stand devices, when the associated golf bag is tipped forward, the base of the bag is caused to be pivoted and lifted up off of the ground and onto a rigid foot and/or "U" arm assembly, with a corresponding loss of stability. Even if the weight of the bag causes the bag to remain upon the ground, the movement of the bag with respect to the "U" arm assembly (or similar actuator) will be impeded by friction with the ground and will cause a jerky action. The roller bottom action of the present invention promotes greater stability during the tipping process and a smoother, more effortless tipping action and, correspondingly, a smoother upward transfer of force for deployment of the leg members 33.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The stand system 10 of the present invention is particularly directed to golf bags of the carry bag variety, and more particularly to soft-sided carry bags, but is adaptable for incorporation into essentially any type of golf bag.

Use of the stand system 10 is simple. When an upright vertical position is desired, for storage or placement on a golf cart, for example, the golf bag 12 is merely stood in the upright position. No manipulation or adjustment of any kind need be made in order to cause the leg members 33 to be retractably held against the golf bag body 18 and out of the way.

When the stand mode is desired, which will usually be the case when the golfer is on the golf course and the bag 12 is taken off of the shoulder, the golf bag 12 is simply set upon the ground and tipped forward. Ordinarily, the weight of the golf clubs which are contained within the bag 12 will be sufficient to overcome the biasing force of the arm members (80 and 82). The smooth roller bottom action of the conformable foot plate 88 and arcuate bottom area 100 provide that the tipping of the golf bag 12 and deployment of the leg members 33 is smooth and stable and that the golf bag 12 does not awkwardly lean or fall to one side during the deployment.

The "Y" shape design of the actuator rod subassembly 40, with the attendant instantaneous activation of the leg members 33, makes use of the present invention in long grass, and on soft ground and hills, particularly convenient. No impedance of the leg members 33 occurs due to a delay in activation, unlike known stand systems in which the legs are not activated until the golf bag has been tipped farther forward to a position at which the legs are likely to find interference from the grass or hill.

After the appropriate club has been selected and the shot made, the simple act of lifting the golf bag 12 from the ground causes the leg members 33 to retract as the tensioned arm members (80 and 82) pull inwardly together. No additional spring or elastic device that might be lost or quickly worn out is needed to insure that the retraction is strong and complete.

The efficient operation, ease of use, and sleek design of the stand system 10 are expected to appeal to a great number of golfers. For these reasons and numerous others as set forth previously herein, it is expected that the industrial applicability and commercial utility of the present invention will be extensive and long lasting.

What is claimed is:

1. An automatic golf bag stand system, comprising:

a golf bag having a base member and a front portion, the base member having a bottom surface, a portion of the bottom surface having an inclined aspect, the inclined bottom surface portion having a lower end and a higher end as relative to a ground surface when said golf bag in an upright position, the higher end in the direction of the front portion;

a ground engaging member having a first end and a second end, the first end being hingedly attached at the lower end of the inclined bottom surface portion;

a pair of leg members pivotally attached to the front portion; and actuation means for pivoting said leg members, said actuation means being connected to the ground engaging member second end whereby a tilting of said golf bag in the direction of the front portion causes an upward ground force to be exerted upon said ground engaging member and upon said actuation means to pivot said leg members thereby, the inclined bottom surface portion and attachment of said ground engaging member thereto increasing the stability of said golf bag during the tilting by permitting at least some portion of the bottom surface to remain in contact with the ground surface.

2. The stand system of claim 1 wherein the inclined bottom surface portion is arcuately shaped.

3. The stand system of claim 2 wherein said ground engaging member is resilient and substantially conformable to the arcuate inclined bottom surface portion.

4. The stand system of claim 1 wherein the second end of said ground engaging member extends beyond the higher end of the inclined bottom surface portion.

5. The stand system of claim 1 wherein the base member bottom surface includes a hinge slot for flexible hinged attachment of said ground engaging member first end therein.

6. The stand system of claim 1 wherein the base member bottom surface includes at least one stabilizer support for biasing the golf bag in the vertical direction.

7. The stand system of claim 1 wherein said actuation means includes a pair of resilient arm members.

8. The stand system of claim 1 wherein said actuation means includes a substantially rigid rod member.

9. The stand system of claim 1 wherein said actuation means includes a pair of resilient arm members conjoined to a substantially rigid rod member in a symmetrical "Y"-shaped configuration, the rod member being connected to the ground engaging member second end.

10. The stand system of claim 9 wherein the rod member has a length, the arm members having a length less than that of the rod member.

11. An automatic golf bag stand system, comprising:

a golf bag having a base member and a front portion;

a pair of leg members pivotally attached to the front portion;

a Y-shaped actuating member extending vertically along the front portion, said actuating member having a plane of symmetry and including a relatively long substantially rigid rod member conjoined by a Y connector situated at an upper end thereof to a pair of relatively short resilient arm members, the rod member having a lower end, each arm member having an upper end, the arm member upper ends being pivotally attached to respective said leg members; and ground engaging driving means for imparting upward driving force to said Y-shaped actuating member, said ground engaging driving means being attached to the rod member lower end.

12. The stand system of claim 11 wherein the arm members are made of a wire, the wire being of a resilient gauge.

13. The stand system of claim 11 further including a retainer attached to the front portion of said golf bag for slidable retention of the rod member.

14. The stand system of claim 11 wherein the base member has a bottom surface and a perimeter, a portion of the bottom surface having an inclined aspect, the inclination being upward in the direction of the golf bag front portion, the ground engaging driving means including a foot plate having a first end and a second end, the first end being hingedly attached to the base member bottom surface, the second end being pivotally connected to the rod member lower end.

15. An automatic golf bag stand system, comprising:

a golf bag having a base member and a front portion, the base member having a bottom surface, a portion of the bottom surface having an inclined aspect, the inclined bottom surface portion having a lower end and an upper end, the upper end in the direction of the front portion;

a ground engaging member having a first end and a second end, the first end being hingedly attached to the base member bottom surface;

a pair of leg members extending vertically along the front portion, said actuatings having a plane of symmetry and including a substantially rigid rod member having a lower end attached to the ground engaging member second end and an upper end;

a Y connector substrated at the upper end of said rod member, and a pair of resilient arm members conjoined at respective lower ends to the Y connector, each arm member having an upper end being attached to a respective one of said leg members.

16. The stand system of claim 15 wherein the inclined bottom surface portion is arcuately fashioned.

17. The stand system of claim 16 wherein said ground engaging member is resilient and substantially conformable to the arcuate inclined bottom surface portion.

18. The stand system of claim 15 wherein the rod member has a length, the arm members having a length less than that of the rod member.

19. The stand system of claim 15 wherein the arm members are made of a wire, the wire being of a resilient gauge.

* * * * *

UNITED STATES PATENT AND TRADEMARK OFFICE

CERTIFICATE OF CORRECTION

PATENT NO. : 5,762,189
DATED : 06/09/98
INVENTOR(S) : REIMERS, Eric W.

It is certified that error appears in the above-identified patent and that said Letters Patent is hereby corrected as shown below:

Column 14, line 26 (claim 15); After "a pair of leg members" and before "extending vertically", insert --pivotally attached to the front portion; and a Y-shaped actuating member--

Column 14, line 27 (claim 15); After "portion, said" delete "actuatings" and substitute therefor --actuating member--

Column 14, line 33 (claim 15); After "a Y connector" delete "substrated" and substitute therefor --situated--

Signed and Sealed this

Thirteenth Day of July, 1999

*Attest:*

*Attesting Officer*

Q. TODD DICKINSON

*Acting Commissioner of Patents and Trademarks*

US005762189B1

REEXAMINATION CERTIFICATE (3876th)

United States Patent [19] [11] B1 5,762,189

Reimers [45] Certificate Issued Sep. 14, 1999

[54] GOLF BAG STAND SYSTEM

[76] Inventor: Eric W. Reimers, 1235 Starwood, Missoula, Mont. 59802

Reexamination Request:
No. 90/005,129, Oct. 30, 1998

Reexamination Certificate for:

| | |
|---|---|
| Patent No.: | **5,762,189** |
| Issued: | **Jun. 9, 1998** |
| Appl. No.: | **08/794,196** |
| Filed: | **Jan. 24, 1997** |

Certificate of Correction issued Jul. 13, 1999.

[51] Int. Cl.[6] ..... A63B 55/00

[52] U.S. Cl. ..... 206/315.7; 248/96

[58] Field of Search ..... 206/315.7; 248/96

[56] References Cited

U.S. PATENT DOCUMENTS

| | | | |
|---|---|---|---|
| 5,549,263 | 8/1996 | Maeng | 248/96 |
| 5,829,719 | 11/1998 | Han | 206/315.7 |

*Primary Examiner*—Stephen P. Garbe

[57] ABSTRACT

A stand system (10) for golf bags provide an automatic leg deployment and retraction capacility and offers an exceedingly smooth and efficient operation and design. The stand system (10) includes a golf bag (12) having a base member (16) whose bottom surface (92) includes an arcuate bottom area (100), and a stand assembly (14) which includes a pair of leg members (33), a top pivot subassembly (38), an actuator rod subassembly (40), and a foot pivot subassembly (42). The actuator rod subassembly (40) includes a pair of resilient wire arm members (80 and 82) connected via a "Y" connector (84) to a stiff rod member (78) whose length extends to the foot pivot subassembly (42). The "Y" design simultaneously provides for an instantaneous deployment of the leg members (33) upon tilting of the golf bag (12) forward while also eliminating the need for a supplemental spring or band for good retraction of the leg members (33) against the golf bag body (18). The foot pivot subassembly (42) includes a foot plate (88) which is hinged on the base member bottom surface (92) and which is sufficiently flexible to be able to conform itself to the arcuate bottom area (100). When the golf bag (12) is tipped forward, the golf bag (12) is able to "roll" upon both the bottom surface (92) and the foot plate (88) as the foot plate (88) is forced upward to drive the rod member (78). The rolling action provides an exceptionally smooth deployment of the leg members (33) and also causes the golf bag (12) to remain in continual contact with the ground and be more stable as it is tilted.

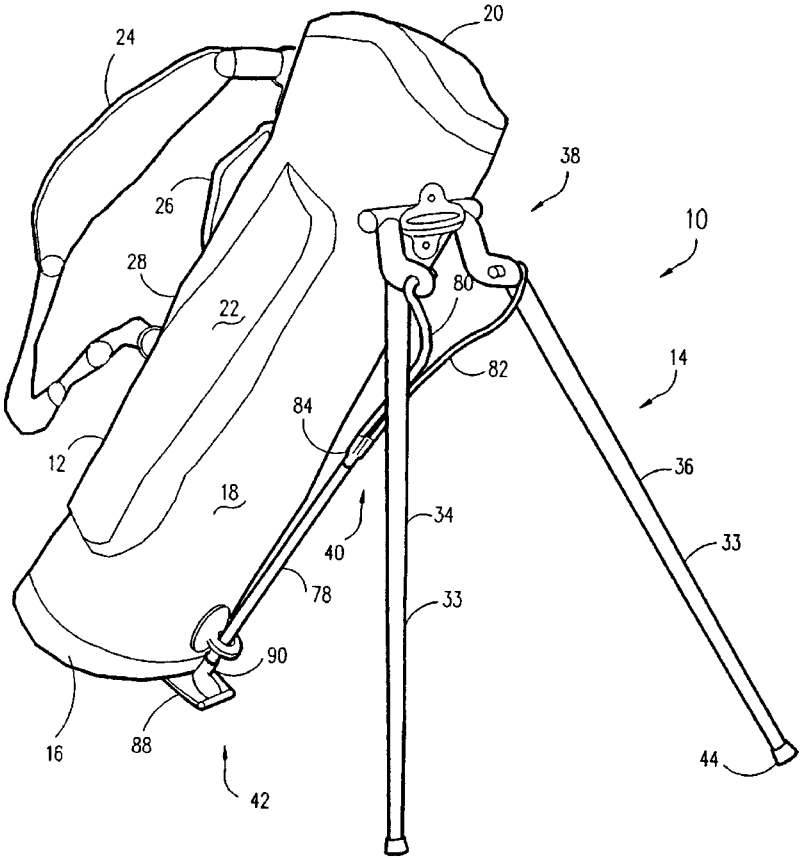

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 11–19 is confirmed.

Claims 2 and 3 are cancelled.

Claim 1 is determined to be patentable as amended.

Claims 4–10, dependent on an amended claim, are determined to be patentable.

1. An automatic golf bag stand system, comprising:

a golf bag having a base member and a front portion, the base member having a bottom surface, a portion of the bottom surface having an inclined aspect, the inclined bottom surface portion having a lower end and a higher end as relative to a ground surface when said golf bag in an upright position, the higher end in the direction of the front portion;

a ground engaging member having a first end and a second end, the first end being hingedly attached at the lower end of the inclined bottom surface portion;

a pair of leg members pivotally attached to the front portion; and actuation means for pivoting said leg members, said actuation means being connected to the ground engaging member second end whereby a tilting of said golf bag in the direction of the front portion causes an upward ground force to be exerted upon said ground engaging member and upon said actuation means to pivot said leg members thereby *assuming stand mode, said inclined bottom surface forming a continuously arcuate bottom surface curve extending from said lower end of said inclined bottom surface to said front portion, and said ground engaging member being flexibly resilient such that said ground engaging member conforms to said continuously arcuate bottom surface curve when said leg members are in stand mode*, the inclined bottom surface portion and attachment of said ground engaging member thereto increasing the stability of said golf bag during the tilting by permitting at least some portion of the bottom surface to remain in contact with the ground surface.

* * * * *